US005516102A

United States Patent [19]

Polk, III et al.

[11] Patent Number: 5,516,102

[45] Date of Patent: May 14, 1996

[54] GAME APPARATUS

[75] Inventors: Louis F. Polk, III, Excelsior; Aaron J. Moriarity, Mound; Paul A. Pilosi, Minneapolis, all of Minn.

[73] Assignee: Leisure Incorporated, Chanhassen, Minn.

[21] Appl. No.: 316,296

[22] Filed: Sep. 30, 1994

[51] Int. Cl.[6] ..... A63F 7/00

[52] U.S. Cl. ..... 273/119 R

[58] Field of Search ..... 273/118 R, 119 R, 273/94, 85 E, 85 F, 121 R

[56] References Cited

U.S. PATENT DOCUMENTS

| | | | |
|---|---|---|---|
| 1,523,684 | 1/1925 | Canale et al. | 273/119 R |
| 1,772,006 | 8/1930 | Hutchison | 273/119 R |
| 2,960,339 | 11/1960 | Bush . | |
| 3,033,569 | 5/1962 | Hunt . | |
| 3,718,331 | 2/1973 | Scott | 273/119 R |
| 4,046,380 | 9/1977 | Goldfarb et al. | 273/119 R |
| 4,230,318 | 10/1980 | Dimond | 273/119 R |
| 4,828,263 | 5/1989 | Nordman . | |
| 4,867,454 | 9/1989 | Horvath et al. | 273/119 R |
| 4,949,967 | 8/1990 | Todokoro | 273/119 R X |
| 4,971,324 | 11/1990 | Grabel et al. | 273/119 R X |
| 5,222,735 | 6/1993 | Savage | 273/85 F X |
| 5,288,085 | 2/1994 | Young | 273/119 R X |
| 5,368,300 | 11/1994 | Becker | 273/119 R X |

FOREIGN PATENT DOCUMENTS

| | | | |
|---|---|---|---|
| 949088 | 6/1974 | Canada | 273/119 R |
| 2118847 | 11/1983 | United Kingdom | 273/119 R |

*Primary Examiner*—William E. Stoll
*Attorney, Agent, or Firm*—Anthony G. Eggink

[57] ABSTRACT

A game apparatus includes a game surface, a game piece which is movable on the game surface, a pair of striker assemblies for moving the game piece on the game surface and a fence assembly which cooperates with the striker assemblies for retaining the game piece within a confined area on the game surface. The striker assemblies are movable in both longitudinal and transverse directions on the game surface, and they are attached to movable sections of the fence assembly so that the confined playing area on the game surface is varied as the striker assemblies are moved during the course of game play.

20 Claims, 6 Drawing Sheets

GAME APPARATUS

BACKGROUND AND SUMMARY OF THE INVENTION

The instant invention relates to game apparatus and more particularly to a goal scoring game apparatus of the general type in which game players manipulate striker assemblies for propelling game elements during the course of game play.

The general concept of providing a game apparatus wherein game players are required to manipulate striker assemblies to propel game elements, such as game balls, during the course of game play has previously been incorporated into a wide variety of amusement games. For example, this concept has previously been incorporated into a wide variety of pinball-type games as well as a variety of competitive parlor game assemblies in which game players are required to attempt to score goals from opposite ends of a confined game surface. The apparatus disclosed in the U.S. Pat. Nos. to Bush, U.S. Pat. No. 2,960,339; Hunt, U.S. Pat. No. 3,033,569; Scott, U.S. Pat. No. 3,718,331; Goldfarb et al., U. S. Pat. No. 4,046,380; Nordman, U.S. Pat. No. 4,828,263; and Grabel et al., U.S. Pat. No. 4,971,324, are generally exemplary of game apparatus of this general type.

The instant invention provides a board game apparatus which adds a new dimension to games of the above-described type. Specifically, the instant invention provides a game apparatus comprising a pair of striker assemblies which are movable on a game surface in both longitudinal and transverse directions and a fence assembly which is attached to the striker assemblies for movement therewith. Still more specifically, the game apparatus of the instant invention comprises a game surface, a game piece which is movable on the game surface, a fence assembly, and at least one striker assembly cooperating with the fence assembly for retaining the game piece within a confined area on the game surface and operable for moving the game piece on the game surface. The striker assembly is disposed on the game surface so that it is both longitudinally and transversely movable thereon, and the apparatus preferably comprises a pair of striker assemblies which are positioned adjacent longitudinally opposite ends of the game surface. The fence assembly preferably comprises a pair of transversely spaced stationary side portions and two pairs of movable connector portions which are movably connected between the side portions of the fence assembly and the striker assemblies so that the confined area defined by the fence assembly and the striker assemblies varies as the striker assemblies are moved on the game surface. The connector portions of the fence assemblies are preferably pivotally connected to the striker assemblies and slidably connected to the side portions so that the connector portions slide relative to the side portions as the striker assemblies are moved on the game surface. Accordingly, as the striker assemblies are moved on the game surface, the overall configuration and dimension of the confined area defined by the fence assembly and the striker assemblies is varied to make it more difficult for game players to score goals and also to vary the manner in which the game piece is deflected off the fence assembly during game play.

It has been found that the instant invention provides an apparatus which can be effectively utilized in a challenging, high speed action game. Specifically, it has been found that the game apparatus of the instant invention is effectively adapted for use in a game in which players are required to quickly move their striker assemblies to both defend their own goal areas and to propel game pieces toward the goal areas of their opponents. It has been further found that because the striker assemblies are movably positioned on the game surface, and because the configuration of the fence assembly is changeable as the striker assemblies are moved on the game surface, the apparatus of the instant invention is operative in a challenging high speed game in which game players are required to skillfully move their striker assemblies to both avoid being scored upon and to attempt to score goals on their opponents.

Accordingly, it is a primary object of the instant invention to provide an effective action game apparatus comprising striker assemblies which are both longitudinally and transversely movable on a game surface.

Another object of the instant invention is to provide a game apparatus comprising a pair of striker assemblies which are movably positioned on a game surface and a fence assembly which is attached to the striker assemblies so that the configuration of the confined area defined by the fence assembly and the striker assemblies is varied as the striker assemblies are moved on the game surface.

An even still further object of the instant invention is to provide a game apparatus comprising a pair of striker assemblies, and a fence assembly including a pair of stationary side portions and two pairs of movable connector portions which are movably attached to the striker assemblies and slidably attached to the side portions.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
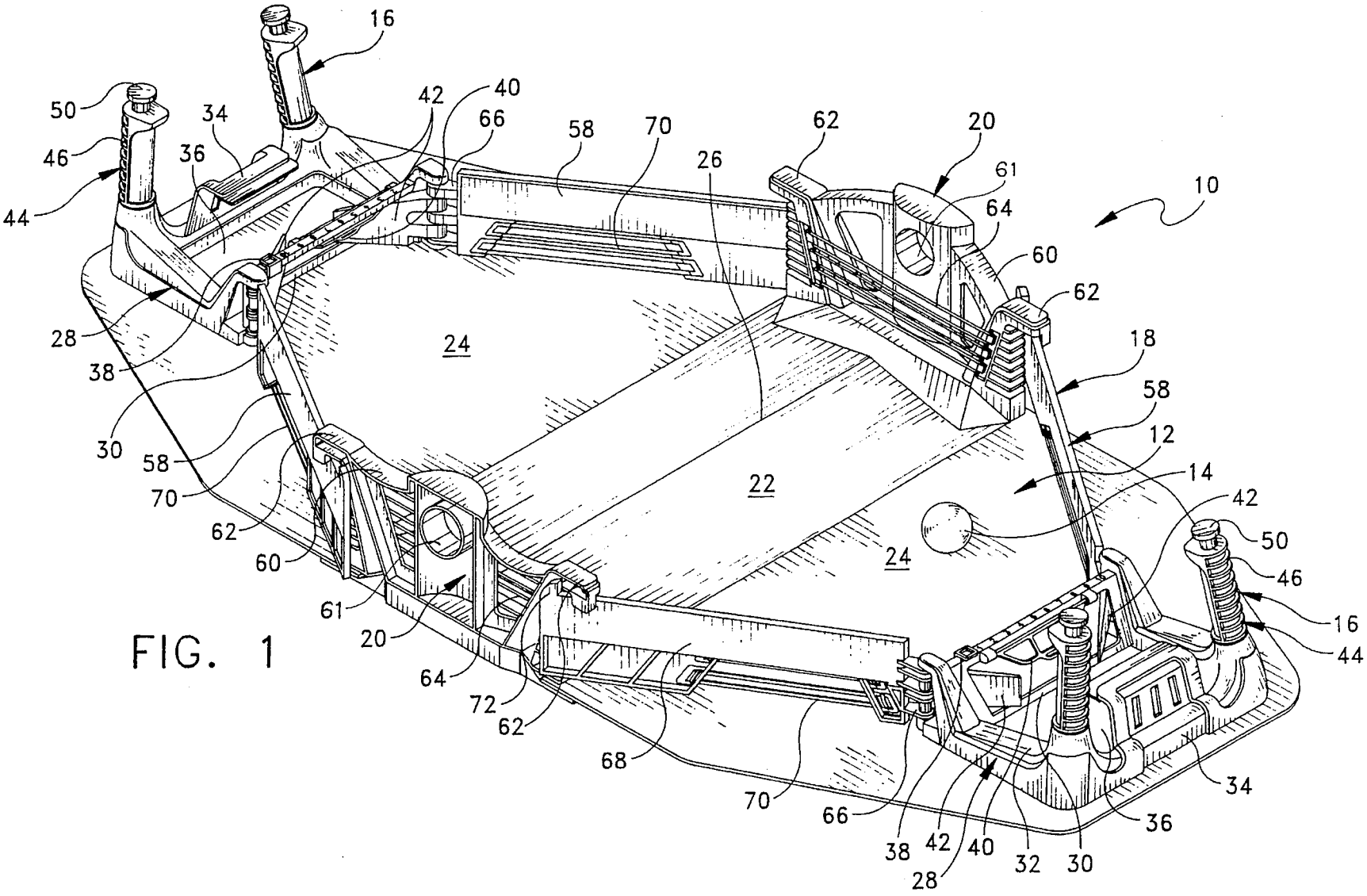
FIG. 1 is a perspective view of the game apparatus of the instant invention.
Figure 2:
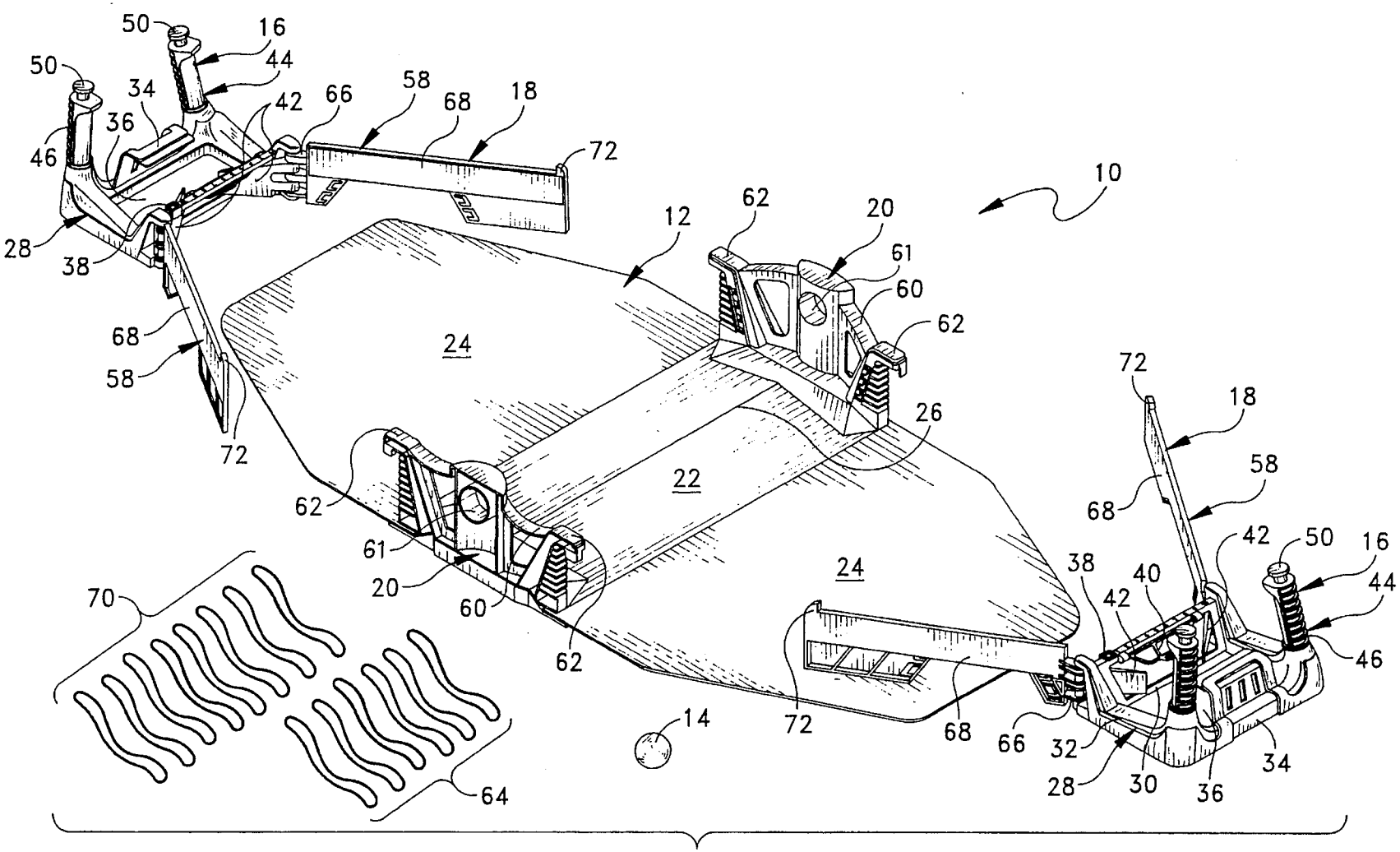
FIG. 2 is an exploded perspective view thereof.

Referring now to the drawings, the game apparatus of the instant invention is illustrated and generally indicated at 10 in FIGS. 1, 2, 7 and 8. The apparatus 10 comprises a game surface generally indicated at 12, a game element 14, a pair of striker assemblies generally indicated at 16, and a fence assembly generally indicated at 18. The fence assembly 18 includes a pair of side portions generally indicated at 20 which are permanently attached to the game surface 12, and the and the striker assemblies 16 are pivotally attached to the fence assembly 18 so that they cooperate therewith to define a confined area on the game surface 12. The striker assemblies 16 are, however, supported on the game surface 12 so that they are movable in both longitudinal and transverse directions thereon during the course of game play. Accordingly, the game apparatus 10 is operable in an action game in which game players are required to move their striker assemblies 16 to engage the game piece 14 during the course of game play in order to attempt to score goals by passing the game piece 14 into a designated area of an opponent's striker assembly 16.

The game surface 12 comprises a center section 22 and a pair of removable end sections 24. The center section 22 extends slightly upwardly from the end sections 24 to a centerline 26 which defines the longitudinal center of the game surface 12. Accordingly, the center portion of the center section 22 is raised slightly to cause the game piece 14 to always roll toward one of the ends of the game surface 12.

The game piece 14 preferably comprises a spherical ball which is freely movable on the game surface 12 within the confined area defined by the fence assembly 18 and the striker assemblies 16.

The striker assemblies 16 define goal areas at opposite ends of the apparatus 10, and they are also adapted for striking the game piece 14 in order to move it on the game surface 12 during the course of game play. The striker assemblies 16 each comprise a frame portion 28 which includes a forward goal frame portion 30, a pair of side portions 32, and a rear portion 34, all of which cooperate to define a goal area 36. Each of the striker assemblies 16 also includes a scorekeeping element 38 which is slidably positionable along the upper portion of the frame portion 30 thereof to indicate game score. The striker assemblies 16 each further comprises a pivotally mounted retainer section 40 which extends downwardly from the upper portion of the frame portion thereof 30 for retaining a game element 14 in the goal area 36 once it passes through the frame portion 30.

Figure 3:
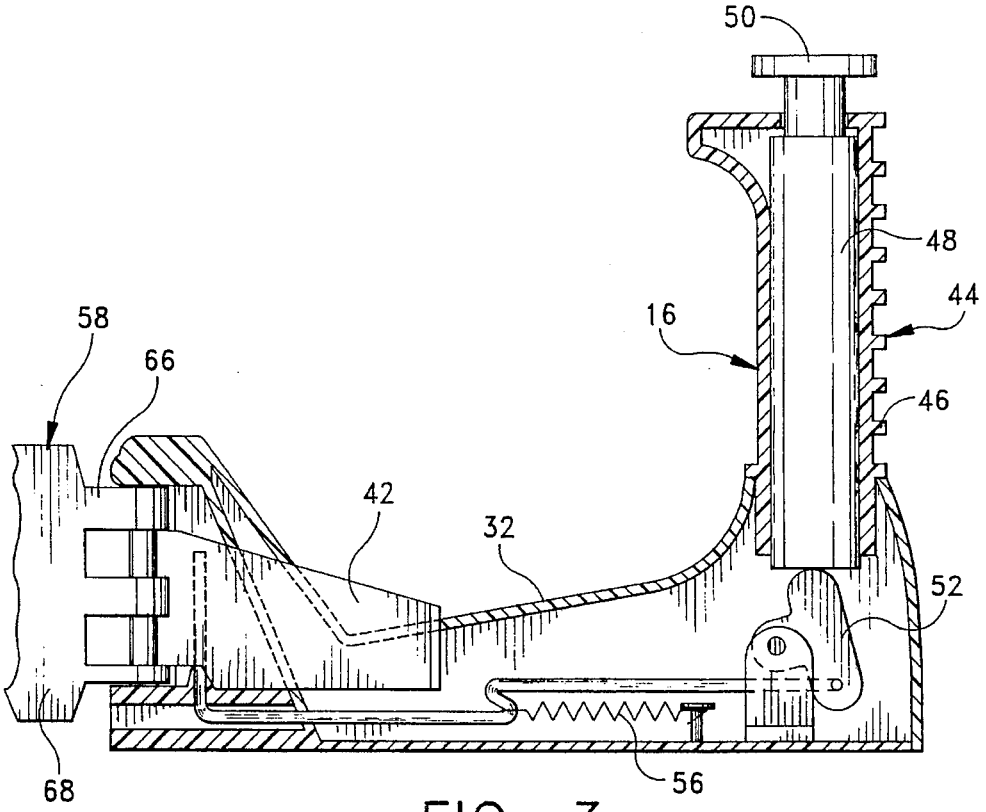
FIGS. 3 and 4 are sectional views illustrating the operation of one of the striker assemblies.
Figure 4:
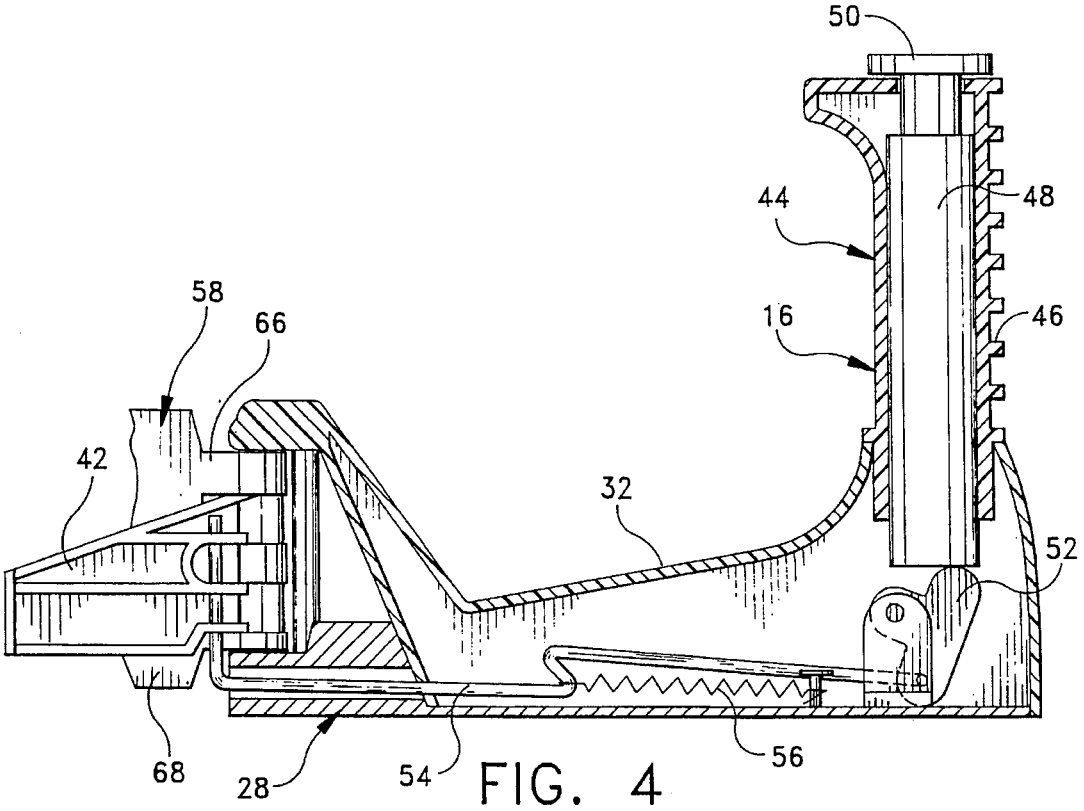
Figure 5:
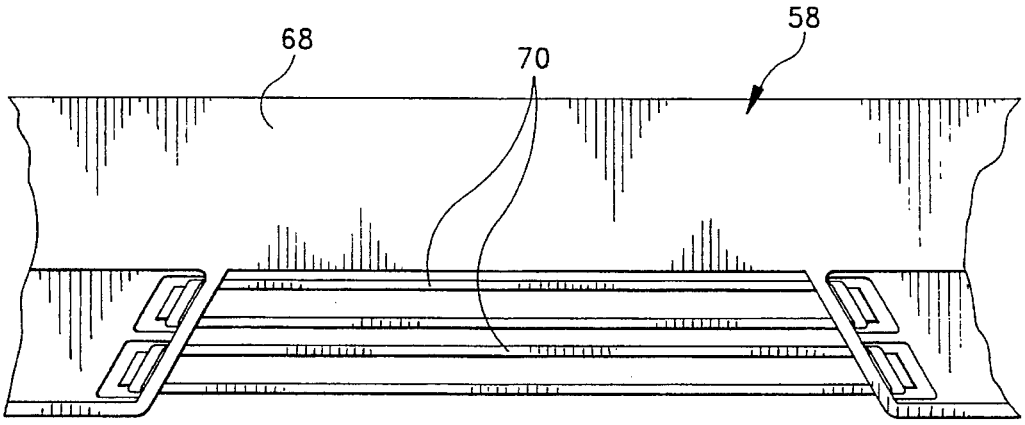
FIG. 5 is a fragmentary elevational view of one of the connector portions of the fence assembly.
Figure 6:
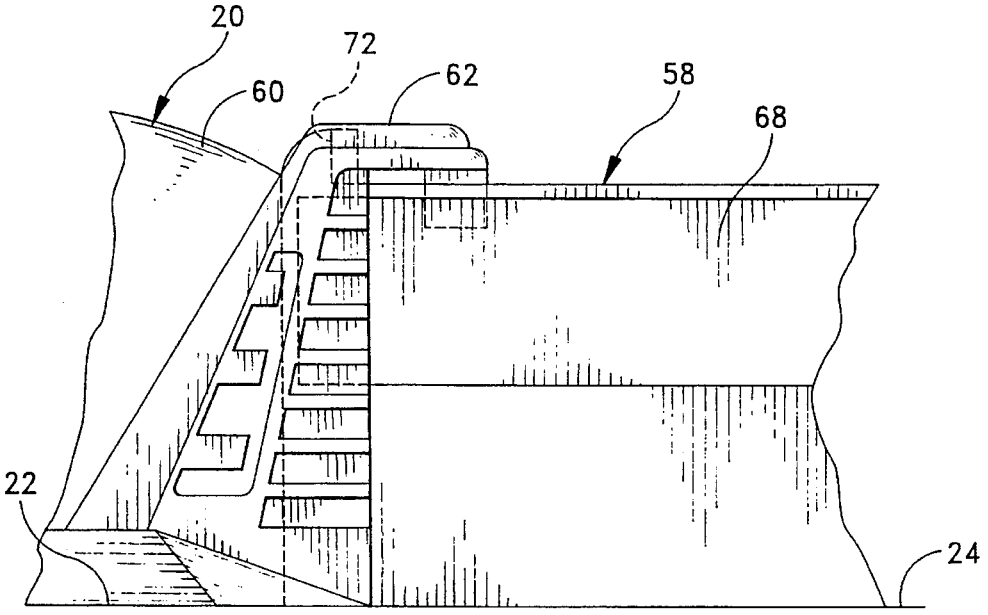
FIG. 6 is a fragmentary elevational view of the interconnected portions of a side portion and an associated connector portion of the fence assembly.
Figure 7:
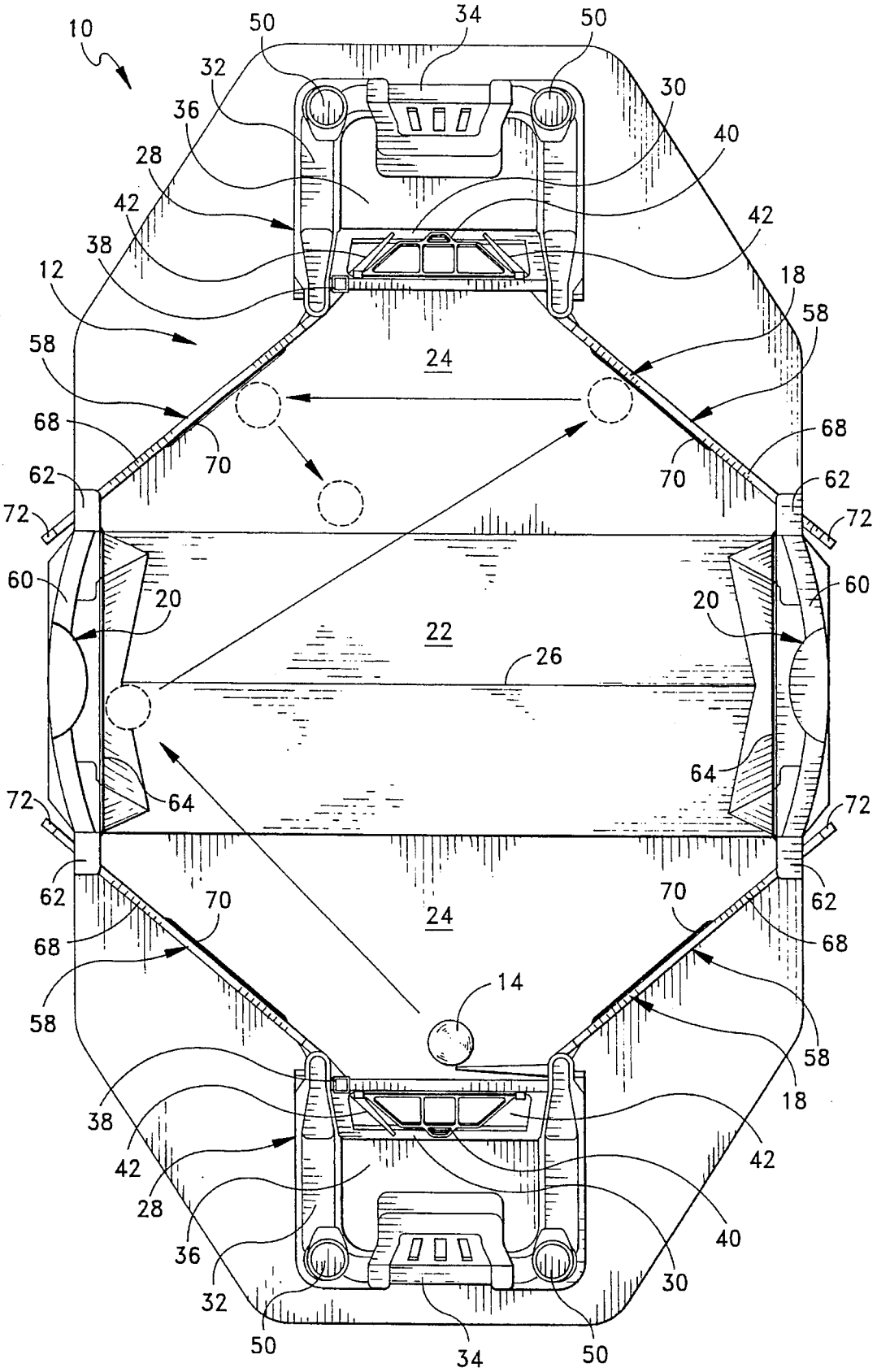
FIGS. 7 and 8 are top plan views illustrating the operation of the game apparatus.
Figure 8:
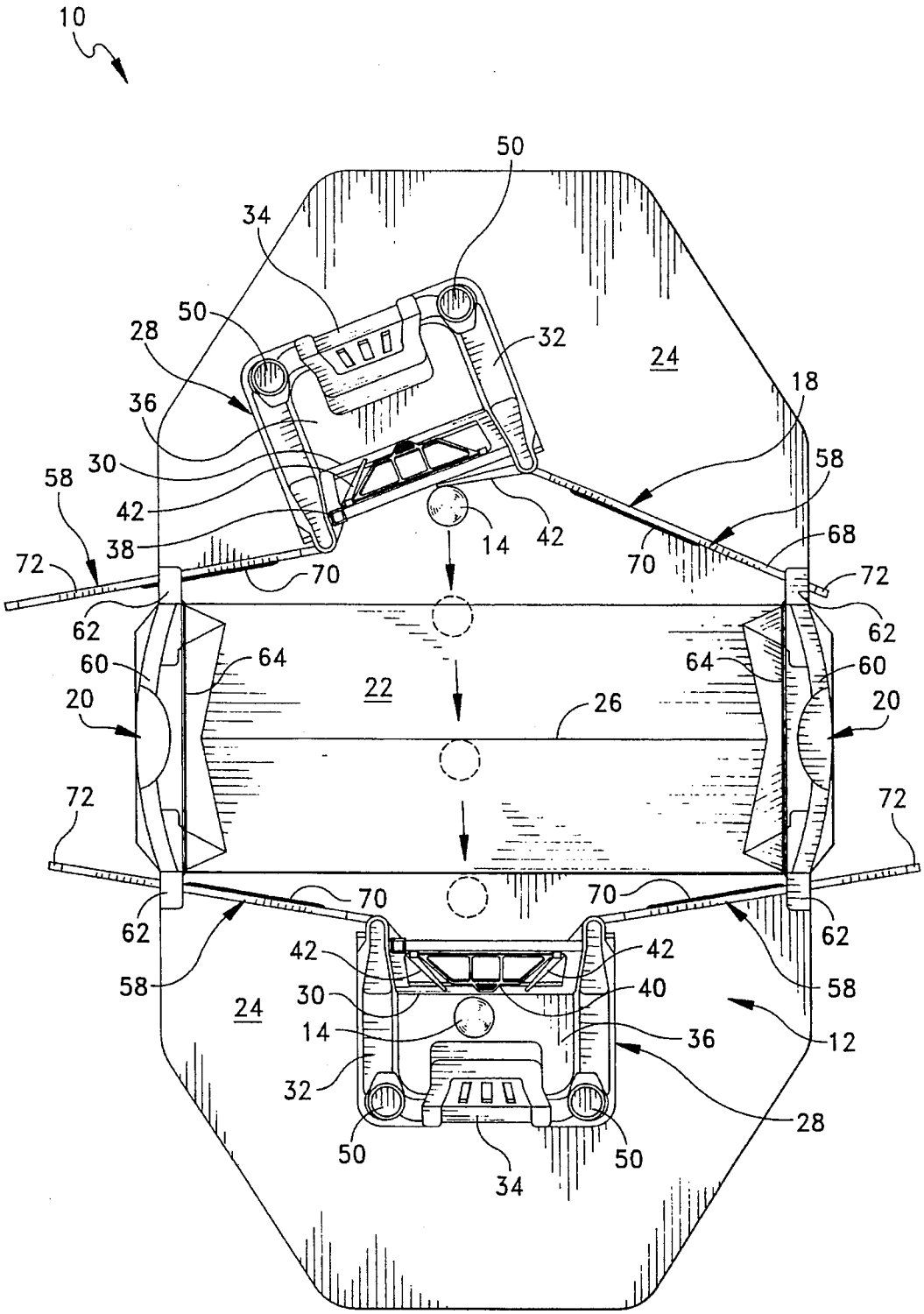

Referring now more specifically to FIGS. 3 and 4, the striker assemblies 16 each further comprise a pair of flipper elements 42 which are manually operable with plunger assemblies 44 for engaging the game piece 14 in order to propel it towards an opponent's goal or to guard a player's own goal. Each of the plunger assemblies 44 comprises a plunger cylinder 46 which extends upwardly from the rear portion of the side frame portion 32 thereof and a plunger element 48 which is slidably received in the respective plunger cylinder 46 thereof. Each of the plunger elements 48 includes an upper cap portion 50 which is manually engageable by a thumb of a user grasping the cylinder 46 thereof for depressing the plunger element 48. Each of the plunger assemblies 44 further comprises a cam element 52 which is connected to the respective flipper 42 thereof through a linkage rod 54. Each of the cam elements 52 is pivotable in the manner illustrated in FIGS. 3 and 4 by depressing the respective plunger element 48 thereof downwardly to cause corresponding pivotal movement in the flipper 42 thereof, and a return spring 56 is provided for returning each flipper element 42 to its initial position and also for returning the associated cam element 52 and plunger element 48 to their initial positions. Accordingly, the plunger assemblies 44 are operable during the course of game play for rapidly pivoting the flipper elements 42 in order to propel the game element 14 on the game surface 12 as well as for protecting the goal opening defined by the frame portion 30 thereof. Still further, because the striker assemblies 16 are movable on the game surface 12, the striker assemblies 16 can be repositioned to more effectively strike the game piece 14 with the flippers 42, or to prevent game piece 14 from passing through the respective frame portion 30 thereof.

The fence assembly 18 comprises the side portions 20 which are permanently attached to the center portion 22 of the game surface 12 and two pairs of movable connector portions generally indicated at 58. The side portions 20 each comprise a frame portion 60 having a game piece starting aperture 61 therein and having a pair of outwardly and downwardly extending retainer arm portions 62 thereon, and a plurality of elastic bands 64 are assembled on the frame portions 60 so that they cooperate therewith to provide a resilient confining structure which is resiliently engageable by the game piece 14 during the course of game play. The connector portions 58 include pivotal mounting sections 66 which are pivotally connected to the striker assemblies 16 about the same axes of pivotal movement as the flippers 42. The connector portions 58 further comprise main wall sections 68 having resilient elastic bands 70 thereon and upwardly extending terminal retainer tabs 72. The connector portions 68 are slidably received beneath the arm portions 62 of the side portions 20 so that the connector portions 58 are slidable on the game surface 12, but retained in slidably connected relation with the side portions 20. In other words, the connector portions 68 are slidable with respect to the side portions 20 to allow the striker assemblies 16 to be freely moved in both longitudinal and transverse directions on the game surface 12. However, the tabs 72 are engageable with the arm portions 62 to prevent the connector portions 68 from becoming disengaged from the side portions 20 as long as the striker assemblies 16 attached thereto are maintained on the game surface 12.

Accordingly, during the course of game play, the game element 14 is placed on the game surface 12 and game players are required to manipulate their plunger assemblies 44 in order to strike the game piece 14 so that it is advanced toward their opponent's goal and/or to prevent the game piece 14 from passing through their own goal frame 30 and into the corresponding goal area 36. Because the striker assemblies 16 are freely movable on the game surface 12, the game piece 14 can be more aggressively engaged in a fast-moving action game. Further, because of the configuration of the confined area defined by the fence assembly 18 and the striker assemblies 16, the game element 14 is more randomly redirected by engagement thereof with the fence assembly 20. Still further, when the game piece 14 engages the elastic elements 70 or 64, it is redirected with greater resiliency to further increase the high speed action of the game apparatus 10, and because the connector portions 58 are movable, they can also be used to propel the game piece 14 during the course of game play.

It is seen, therefore, that the instant invention provides an effective game apparatus which is adapted for use in a novel and highly amusing action game. Game players are required to manipulate their striker assemblies 16 in order to move the game element 14 on the game surface 12, and, in doing so, they are free to move their striker assemblies 16 on the adjacent areas of the game surface 12. Hence, it is seen that the action game apparatus 10 represents a significant advancement in the related art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A game apparatus comprising a game surface having longitudinally opposite end extremities and transversely opposite side extremities;

a game piece adapted to be movably positioned on said game surface;

a fence assembly on said game surface, said fence assembly including a pair of transversely spaced and opposing stationary side portions, said stationary side portions being positioned on said transversely opposite side extremities of said game surface, each said stationary side portion having an end portion, said fence assembly further having a pair of movable connector portions each having a first end and a second end, said movable connector portions being movably and slidably engaged at said first end to said end portion of each said stationary side portion; and at least one striker assembly slidable on said game surface and cooperating with said fence assembly for defining a confined area on said game surface in order to retain and manipulate said game piece thereon, said striker assembly including a goal and a flipper assembly for engaging said game piece, said striker assembly further being pivotally connected to said second end of each said movable connector portion of said fence assembly, said striker assembly and said movable connector portions being operative for moving said game piece on said game surface within said confined area and for varying the configuration and dimensions of said confined area, said striker assembly being disposed on said game surface and being both longitudinally and transversely movable thereon.

2. In the game apparatus of claim 1 further comprising a pair of said striker assemblies adjacent longitudinally opposite extremities of said game surface.

3. In the game apparatus of claim 2, said striker assemblies being attached to said fence assembly for movement with portions thereof.

4. The game apparatus of claim 1 further comprising a pair of said striker assemblies on longitudinally opposite sections of said game surface and two pairs of said connector portions, one pair of said connector portions connecting each of said striker assemblies to said side portions.

5. In the game apparatus of claim 1, said fence assembly being at least partially resilient.

6. The game apparatus of claim 1 wherein said game surface further comprises a center section having opposing ends and a pair of removable end sections, said end sections being constructed and arranged to be removably attached to said opposing ends of said center section.

7. The game apparatus of claim 1 wherein said striker assembly further comprises a frame portion having a goal area, a pair of plunger assemblies and a pair of flipper elements, each said plunger assembly being communicatively attached to one said flipper element.

8. The game apparatus of claim 7 wherein each said plunger assembly further comprises a plunger cylinder, a plunger element, an upper cap portion, a cam element and a linkage rod and wherein said linkage rod has opposing ends, one said linkage rod end being connected to said cam element and said opposing end being connected to said flipper element.

9. The game apparatus of claim 1 wherein each said opposing stationary side portion of said fence assembly has a frame portion and wherein a plurality of first elastic bands are connected to said frame portion for contact with said game element and further wherein each said movable connector portion of said fence assembly has a main wall section and wherein a plurality of second elastic bands are connected to said main wall for contact with said game element.

10. A game apparatus comprising:

a game surface having longitudinally opposite end extremities and transversely opposite side extremities;

a game piece adapted to be movable positioned on said game surface;

a fence assembly on said game surface including opposing stationary side portions fixed on said transversely opposite side extremities of said game surface, at least a portion of said fence assembly being movable relative to said game surface, said movable fence portion having connecting means on at least one end thereof; and at least one striker assembly slidable on said game surface and cooperating with said fence assembly for defining a confined area on said game surface; said striker assembly including a goal having a frontal area and a flipper assembly, said flipper assembly being constructed and arranged to be operative in said frontal area of said goal, said at least one striker assembly being operable for moving said game piece on said game surface within said confined area, said striker assembly being connected to said connecting means of said movable fence portion of said fence assembly and being movable and pivotable therewith in both longitudinal and transverse directions relative said game surface to, thereby, vary the configuration and dimension of said confined area on said game surface.

11. In the game apparatus of claim 10, said connector portions being movably connected to said striker assembly and slidably connected to said connecting means of said side portions, said connector portions being constructed and arranged for sliding in said side portions as said striker assembly is moved on said game surface.

12. In the game apparatus of claim 10 further comprising a pair of said striker assemblies on longitudinally opposite sections of said game surface and two pairs of said movable fence portions, one pair of said movable fence portions connecting each of said striker assemblies to said stationary side portions.

13. A game apparatus comprising a separable game surface having longitudinally opposite end extremities and transversely opposite side extremities;

a game piece adapted to be movably positioned on said game surface;

a fence assembly on said game surface for confining said game element thereon; and a unitary striker assembly having at least one flipper element, a goal and a pair of upwardly extending handle members and being constructed and arranged to slide on said game surface for moving said game element thereon, said striker assembly being both longitudinally and transversely movable on said game surface.

14. The game apparatus of claim 13 wherein said game surface is comprised of a plurality of separable game surface members.

15. The game apparatus of claim 14 wherein said separable game surface members include a center game surface member having a raised surface.

16. The game apparatus of claim 13 wherein said striker assembly is a unitary member comprising a pair of flipper elements and wherein said handle members have means to operate said flipper elements.

17. The game apparatus of claim 13 wherein said fence assembly further comprises a pair of transversely spaced stationary side portions each having an end portion facing said striker assembly, said fence assembly further having a pair of moveable connector portions slidingly connected to said end of each said stationary side portion and being pivotally connected to said striker assembly.

18. The game apparatus of claim 17 wherein resilient members are attached to each said stationary side portions and to each said moveable connector portions.

19. The game apparatus of claim 17 wherein vertically disposed slot portions are disposed in the end of each said stationary side portions and wherein said slot portions are constructed and arranged to receive and capture said movable connector portions.

20. The game apparatus of claim 13 wherein an aperture is disposed through the top of each said stationary side portion for receiving said game piece therethrough.

* * * * *